US008098222B2

(12) United States Patent
Tu et al.

(10) Patent No.: US 8,098,222 B2
(45) Date of Patent: Jan. 17, 2012

(54) LIQUID CRYSTAL DISPLAY AND DISPLAY PANEL THEREOF

(75) Inventors: Chang-Ching Tu, Taipei County (TW); Yu-Chieh Fang, Kaohsiung (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1104 days.

(21) Appl. No.: 11/936,801

(22) Filed: Nov. 8, 2007

(65) Prior Publication Data

US 2008/0238853 A1 Oct. 2, 2008

(30) Foreign Application Priority Data

Mar. 28, 2007 (TW) ..... 96110706 A

(51) Int. Cl.
*G09G 3/36* (2006.01)

(52) U.S. Cl. ..... 345/98; 345/87; 345/92; 345/100

(58) Field of Classification Search ..... 345/87–100, 345/204, 211–213
See application file for complete search history.

(56) References Cited

U.S. PATENT DOCUMENTS

| | | | | |
|---|---|---|---|---|
| 7,362,317 | B2 * | 4/2008 | Yu | 345/204 |
| 2004/0189884 | A1 | 9/2004 | Kim et al. | |
| 2004/0239667 | A1 * | 12/2004 | Takahashi | 345/212 |
| 2007/0115241 | A1 * | 5/2007 | Teranishi | 345/98 |

* cited by examiner

*Primary Examiner* — Kimnhung Nguyen
(74) *Attorney, Agent, or Firm* — Jianq Chyun IP Office

(57) ABSTRACT

A liquid-crystal-display (LCD) and a display panel thereof are provided. The display panel includes a plurality of pixel row units and a plurality of switch units. Each pixel row unit is connected between a scan line and a potential switch line. The first end of each switch unit receives the common voltage provided by the display panel, and the second end of each switch unit is connected to its corresponding potential switch line. Thus, not only the flicker-noise of the display panel is reduced, but also the display-quality of the LCD is promoted.

17 Claims, 7 Drawing Sheets

LIQUID CRYSTAL DISPLAY AND DISPLAY PANEL THEREOF

CROSS-REFERENCE TO RELATED APPLICATION

This application claims the priority benefit of Taiwan application serial no. 96110706, filed on Mar. 28, 2007. All disclosure of the Taiwan application is incorporated herein by reference.

BACKGROUND OF THE INVENTION

1. Field of the Invention

The present invention generally relates to a liquid crystal display and display panel thereof, and more particularly, to a liquid crystal display and display panel thereof which may selectively receive a common voltage by using pixel row units.

2. Description of Related Art

Nowadays, a liquid crystal display (LCD) is widely used, and has replaced cathode ray tube (CRT) display. Therefore, it has become one of the mainstream display for the next generation displays. With the development of the semiconductor technology, several large size liquid crystal displays have been developed, but which also poses another technical challenge, namely flicker noise tends to be more serious in larger size display panel.

There are two kinds of structures for the pixel unites in a conventional display panel, one is as shown in the schematic view for illustrating the structure, of a pixel unit 100 in FIG. 1, and the other is as shown in the schematic view for illustrating the structure of a pixel unit 200 in FIG. 2. Referring to FIG. 1 and FIG. 2, the pixel units 100 and 200 respectively comprise a transistor 101, a liquid crystal capacitance $C_{LC}$, a storage capacitance $C_S$, and a parasitic capacitance $C_{gd}$. And the greatest difference is that the design of the storage capacitance $C_S$ is on a common voltage (Vcom) ($C_S$ on common) in the pixel unit 100, and the design of the storage capacitance $C_S$ is on a scan line $G_{m-1}$($C_S$ on gate) in the pixel unit 200.

Regardless of the structure for pixel unit used, when a gate signal SG outputted from a gate driver (not shown) is rapidly reduced from a high potential $V_H$ to a low potential $V_L$ to result in turning off the transistor 101, and coupling effect caused by the parasitic capacitance $C_{gd}$ will result in decrease in the drain voltage $V_D$ of the transistor 101 by a potential difference $\Delta V_{FT}$, which may be expressed by the equation (1):

$$\Delta V_{FT} = \frac{C_{gd}}{C_{gd} + C_s + C_{LC}} \Delta V_{GP} \tag{1}$$

wherein $\Delta V_{GP}=V_H-V_L$, and the potential difference $\Delta V_{FT}$ is referred to as a feed-through voltage. We can know from the equation (1) that because the feed-through voltages $\Delta V_{FT}$ of the pixel units in conventional display panels are not completely same, there will result in flicker noises of display panels, so as to increase the flicker noise of the liquid crystal display.

In order to decrease the flicker noise generated by feed-through effect mentioned above, known methods have developed various methods for resolving the problem, comprising:

1. modifying the common voltage provided to the display panel according to the feed-through voltage $\Delta V_{FT}$; and 2. using the driving method of a third or fourth order gate signal.

FIG. 3 is a waveform diagram for illustrating the related methods mentioned above. It is suitable for the pixel unit 100 disclosed above. Referring to FIG. 1 and FIG. 3, when the gate signal SG is a high potential $V_H$, the transistor 101 is turned on. At the same time, the source voltage $V_S$ transmitted over the data line SL will be stored on the liquid crystal capacitance $V_{LC}$, such that the potential of the drain voltage $V_D$ will be changed to as the potential of the source voltage $V_S$. However, when the gate signal SG is rapidly reduced from the high potential $V_H$ to the low potential $V_L$, the potential of drain voltage $V_D$ will be reduced by a feed-through voltage $\Delta V_{FT}$. In order to eliminate the flicker noise caused by the feed-through voltage $\Delta V_{FT}$, the related method 1 modifies the common voltage $V_{com}$ of the display panel to the optimum common voltage $V'_{com}$.

However, it must perform a complicated hand measurement to determine the optimum common voltage $V'_{com}$ provided to the display panel at the beginning of modifying the common voltage $V_{com}$ by the related method 1. Furthermore, the properties of each display panel are not completely the same, so the optimum common voltage $V'_{com}$ determined above will not meet completely each display panel.

FIG. 4 is a waveform diagram for illustrating the related method mentioned above. It is suitable for the pixel unit 200 disclosed above. Referring to FIG. 2 and FIG. 4, when the potential of the drain voltage $V_D$ is reduced by a quality of a feed-through voltage $\Delta V_{FT}$, the potential of the drain voltage $V_D$ will be stepped charged to the potential of the source voltage $V_S$ by the compensating voltage $V_P$ provided by the gate signals $SG_{m-1}$ and $SG_m$ during the low potential period in the related method 2.

However, the compensating voltage $V_P$ provided by the related method 2 will be calculated out according to a theoretical equation, but the gate signal SG is generated by the gate driver in the liquid crystal display in the actual application. Thus, during the period of increasing the accuracy on the compensating voltage $V_P$, the complexity of the design on the gate driver is also increased. Therefore, when the related method 2 eliminates the flicker noise of the liquid crystal display, the complexity of the design on the gate driver is also increased. As the result, the liquid crystal display will have more layout area and more waste of the power.

SUMMARY OF THE INVENTION

Accordingly, the present invention is directed to a display panel with many switch units for controlling the time points at that the pixel row units receive the common voltage of the display panel. Thus, the common voltage of the display panel is maintained at an optimal potential, and the design of the circuit on the gate driver is simple. At the result, the problems caused by the feed-through effect may be effectively reduced.

The present invention is also directed to a liquid crystal display including the advantages of the display panel mentioned above. Thus, not only the problems caused by the feed-through effect may be reduced but also the flicker noise of the display panel may be reduced, and thereby promote the display-quality of the LCD.

The present invention provides a display panel. The display panel comprises a plurality of pixel row units and a plurality of switch units. Each the pixel row unit is connected between a scan line and a potential switch line. The first end of each switch unit receives the common voltage provided by the display panel, and the second end of each switch unit is connected to its corresponding potential switch line. Thereby, each switch unit conducts its first end and its second end before the high potential transition of its corresponding gate signal, such that its corresponding pixel row units receive the common voltage derived from the display panel. Furthermore, each switch unit disconnects its first end and its second end before the low potential transition of its corresponding gate signal, such that its corresponding pixel row units will be switched to a floating state.

In one embodiment of the present invention, each pixel row unit mentioned above comprises N pixel units, and the N pixel units correspond to N data lines one by one, wherein N represents integer that is greater than zero. Each pixel unit comprises a first switch and a storage circuit. The first switch is used to determine whether its corresponding data line is electrically connected to the storage circuit. The storage circuit is used to determine the gray level of the display panel.

It is noted that the forementioned storage circuit comprises at least a liquid crystal capacitance, and the first switch is a transistor. Furthermore, the forementioned data line is electrically connected to the source driver of the liquid crystal display.

In one embodiment of the present invention, each switch unit includes at least a switch. And the gate driver of the liquid crystal display generates the forementioned the gate signals and a plurality of potential switch signals, each switch unit may determine the conductive state between the first end and the second end according to its corresponding potential switch signal.

According to another aspect, the present invention provides a liquid crystal display comprising a display panel, a plurality of switch units, and a driving unit. The display panel comprises at least a plurality of pixel low units and each pixel low unit is connected between a scan line and a potential switch line. The first end of each switch unit is used to receive the common voltage of the display panel, and the second end of each switch unit is electrically connected to the potential switch line. Thereby, each switch unit conducts its first end and second end before the high potential transition of its corresponding gate signal, such that its corresponding pixel row unit receives the common voltage derived from the display panel. Furthermore, each switch unit disconnects its first end and second end before the low potential transition of its corresponding gate signal, such that its corresponding pixel row unit may be switched to a floating state. The driving unit is used to drive the display panel.

In one embodiment of the present invention, the driving unit comprises a gate driver and a source driver, wherein the gate driver may be used to generate the gate signals, and the source driver may be used to generate the source voltages required for driving the pixel row units.

The liquid crystal display and display panel thereof provided by the present invention may employ the switch units to control the time points at that the pixel row units receive the common voltage of the display panel. Therefore, not only the flicker noise of the display panel is reduced but also the display-quality of the liquid crystal display may be effectively promoted.

These and other exemplary embodiments, features, aspects, and advantages of the present invention will be described and became more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
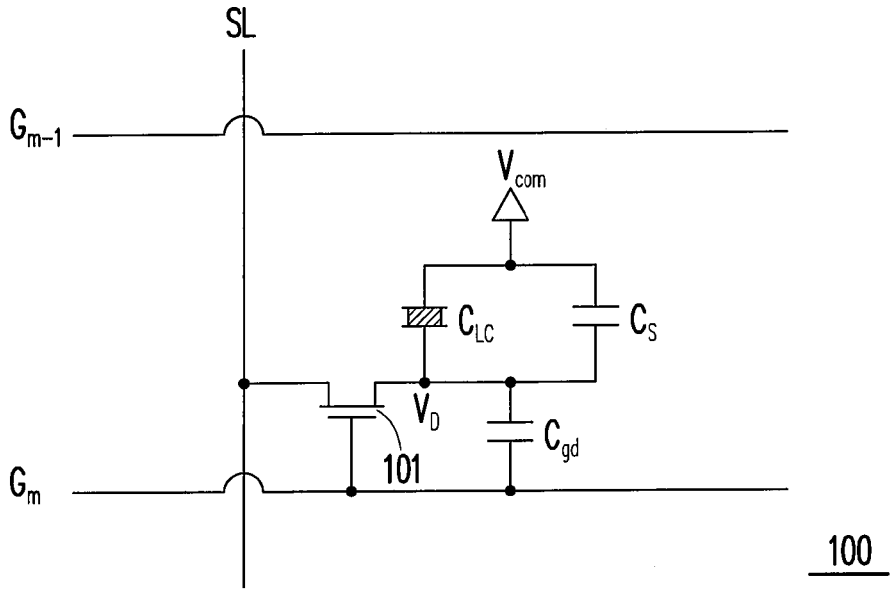
FIG. 1 (PRIOR ART)
FIG. 1 is a schematic view illustrating a structure of a pixel unit of a conventional display panels.
Figure 2:
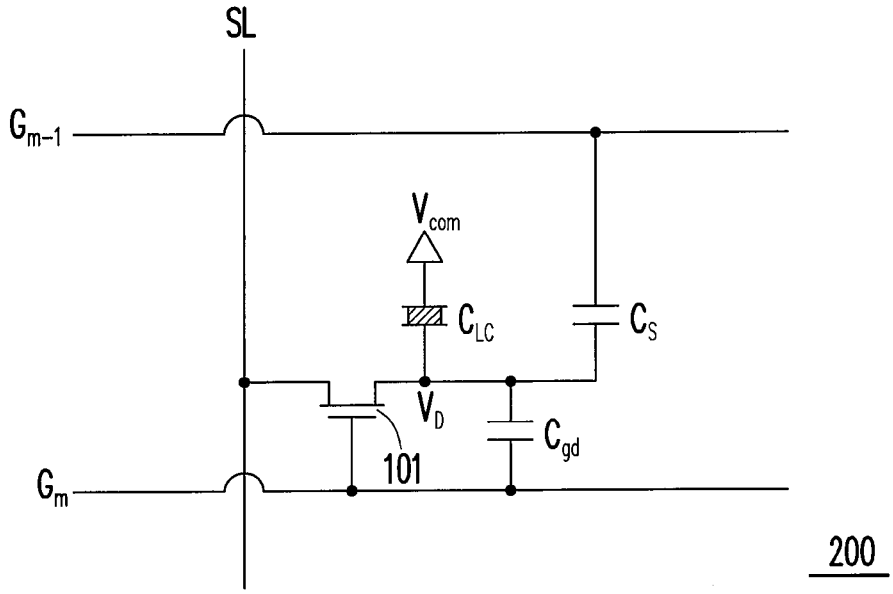
FIG. 2 (PRIOR ART)
FIG. 2 is a schematic view illustrating a structure of another pixel unit of a conventional display panel.
Figure 3:
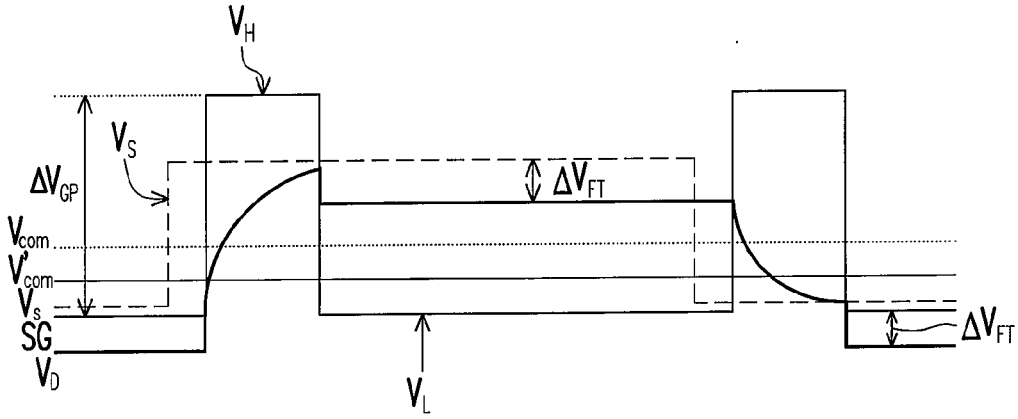
FIG. 3 (PRIOR ART)
FIG. 3 is a waveform diagram for illustrating a conventional method 1.
Figure 4:
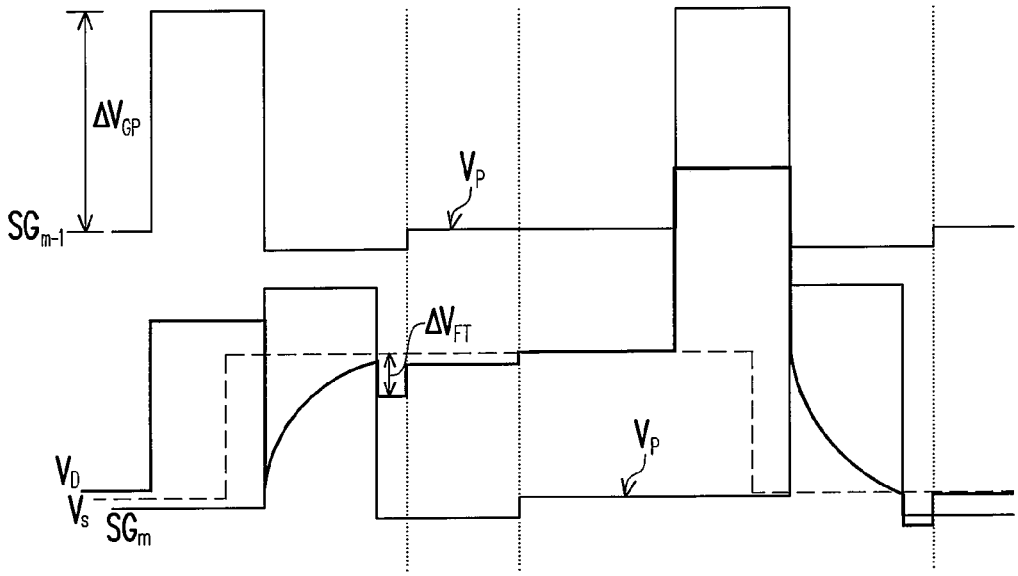
FIG. 4 (PRIOR ART)
FIG. 4 is a waveform diagram for illustrating a conventional method 2.

Reference will now be made in detail to the present preferred embodiments of the invention, examples of which are illustrated in the accompanying drawings. Wherever possible, the same reference numbers are used in the drawings and the description to refer to the same or like parts.

The main technical features of the present invention are that pixel row units may selectively receive the common voltage from a display panel in conjunction with the conductive state between two ends of switch units, thereby the flicker noise caused by a feed-through effect may be eliminated. The display panel and the liquid crystal display of the present invention will be explained below, however, this is not intended to limit the scope of the present invention, it will be understood by those of ordinary skill in the art that various changes in form and details may be made therein without departing from the spirit and scope of the present invention.

Figure 5:
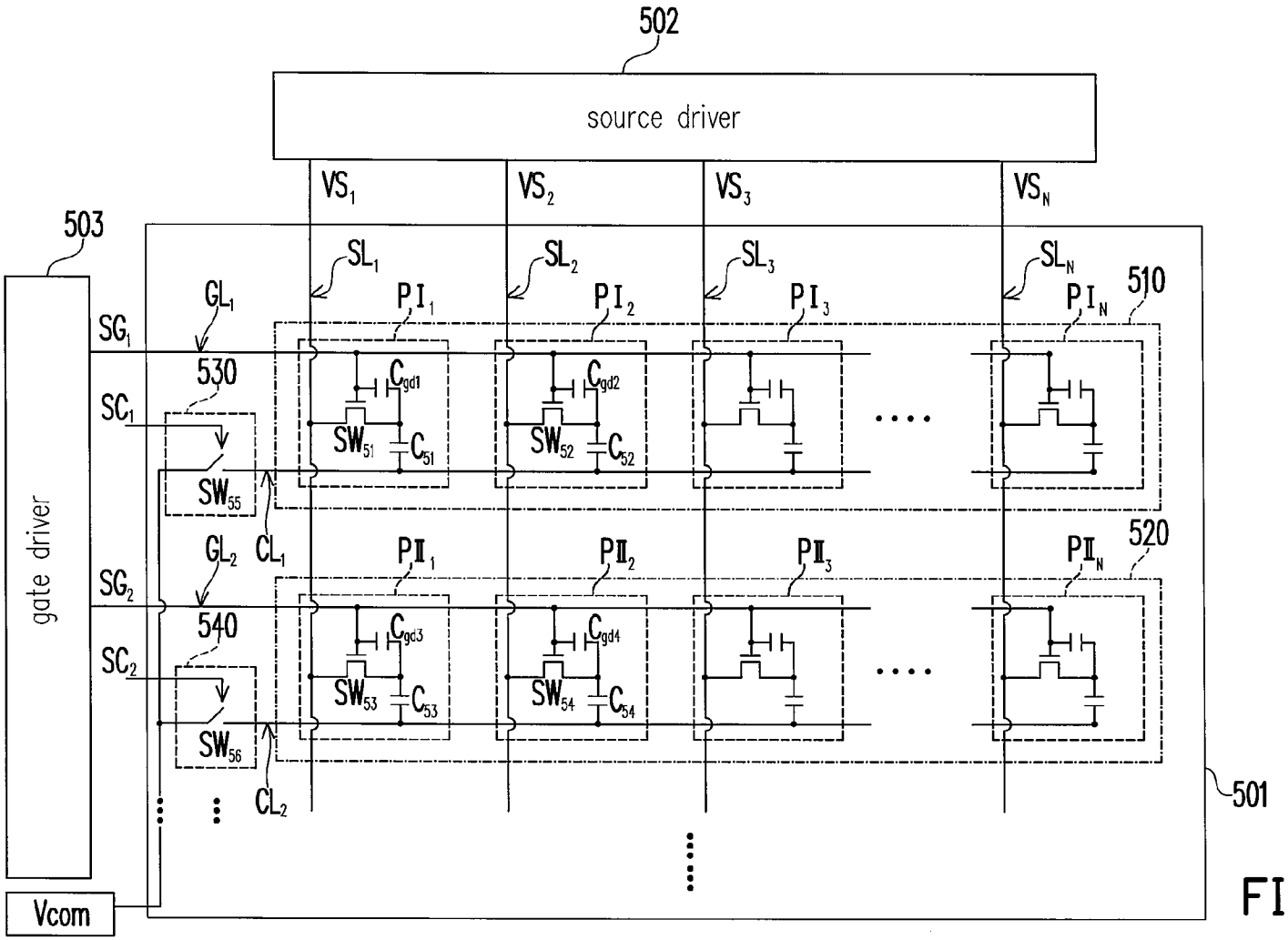
FIG. 5 is a schematic view illustrating a structure of a display panel according to an embodiment of the present invention.

FIG. 5 is a schematic view illustrating a structure of the display panel according to one embodiment of the present invention. Referring to FIG. 5, a display panel 501 comprises a plurality of pixel row units and a plurality of switch units. In order to distinctly represent each member, FIG. 5 only illustrates pixel row units 510 and 520, and switch units 530 and 540. The pixel row units 510 are connected between a scan line $GL_1$ and a potential switch line $CL_1$, and the pixel row units 520 are connected between a scan line $GL_2$ and a potential switch line $CL_2$. The first end of the switch unit 530 is used to receive the common voltage Vcom of the display panel 501, and the second end of the switch unit 530 are electrically connected to the potential switch line $CL_1$. Furthermore, the first end of the switch unit 540 is used to receive the common voltage Vcom of the display panel 501, and the second end of the switch unit 540 is electrically connected to the potential switch line $CL_2$.

The pixel row units 510 comprise N pixel units $PI_1$ to $PI_N$. Wherein N pixel units $PI_1$ to $PI_N$ respectively correspond to N data lines $SL_1$ to $SL_N$, and N represents an integer that is greater than zero. Furthermore, each of the pixel units $PI_1$ to $PI_N$ comprises a switch, a storage circuit, and a parasitic capacitance. It is noted that the switch of each of the pixel units $PI_1$ to $PI_N$ comprises a transistor, and the storage circuit mentioned above comprises at least a liquid crystal capacitance.

For example, the pixel unit $PI_1$ comprises a switch $SW_{51}$, a storage circuit (liquid crystal capacitance $C_{51}$), and a parasitic capacitance $C_{gd1}$. Wherein the first end of the switch $SW_{51}$ is electrically connected to the corresponding data line $SL_1$, and the controlling end of the switch $SW_{51}$ is electrically connected to a scan line $GL_1$. The storage circuit (liquid crystal capacitance $C_{51}$) is connected between the second end of the switch $SW_{51}$ and the potential switch line $CL_1$. The parasitic capacitance $C_{gd1}$ is electrically connected to the scan line $GL_1$ and the second end of the switch $SW_{51}$.

Similarly, the pixel unit $PI_2$ includes a switch $SW_{52}$, a storage circuit (liquid crystal capacitance $C_{52}$), and a parasitic capacitance $C_{gd2}$. Wherein the first end of the switch $SW_{52}$ is electrically connected to the corresponding data line $SL_2$, and the controlling end of the switch $SW_{52}$ is electrically connected to a scan line $GL_1$. The storage circuit (liquid crystal capacitance $C_{52}$) is connected between the second end of the switch $SW_{52}$ and the potential switch line $CL_1$. The parasitic capacitance $C_{gd2}$ is electrically connected to the scan line $GL_1$ and the second end of the switch $SW_{52}$. Similarly, the detailed structures of the pixel units $PI_3$ to $PI_N$ may be deduced, and the detailed description thereof is omitted.

The structures of the forementioned pixel row units 520 are similar to those of the pixel row units 510. The pixel row unit 520 comprises N pixel units $PII_1$ to $PII_N$. Wherein the N pixel units $PII_1$ to $PII_N$ also respectively correspond to N data lines $SL_1$ to $SL_N$. Furthermore, each of the pixel units $PII_1$ to $PII_N$ comprises a switch, a storage circuit, and a parasitic capacitance. Similarly, the switch of each of the pixel units $PII_1$ to $PII_N$ comprises a transistor, and the storage circuit comprises at least a liquid crystal capacitance.

For example, the pixel unit $PII_1$ comprises a switch $SW_{53}$, a storage circuit (liquid crystal capacitance $C_{53}$), and a parasitic capacitance $C_{gd3}$. Wherein the first end of the switch $SW_{53}$ is electrically connected to the corresponding data line $SL_1$, and the controlling end of the switch $SW_{53}$ is electrically connected to a scan line $GL_2$. The storage circuit (liquid crystal capacitance $C_{53}$) is connected between the second end of the switch $SW_{53}$ and the potential switch line $CL_2$. The parasitic capacitance $C_{gd3}$ is electrically connected to the scan line $GL_2$ and the second end of the switch $SW_{53}$.

Similarly, the pixel unit $PII_2$ includes a switch $SW_{54}$, a storage circuit (liquid crystal capacitance $C_{54}$), and a parasitic capacitance $C_{gd4}$. Wherein the first end of the switch $SW_{54}$ is electrically connected to the corresponding data line $SL_2$, and the controlling end of the switch $SW_{54}$ is electrically connected to a scan line $GL_2$. The storage circuit (liquid crystal capacitance $C_{54}$) is connected between the second end of the switch $SW_{54}$ and the potential switch line $CL_2$. The parasitic capacitance $C_{gd4}$ is electrically connected to the scan line $GL_2$ and the second end of the switch $SW_{54}$. Similarly, we can deduce the detailed structures of the pixel units $PII_3$ to $PII_N$, and the detailed description is thereof omitted.

The display panel 501 is suitable for a liquid crystal display, and the source driver 502 and the gate driver 503 contained in the liquid crystal display are well known to those skilled in the art. Wherein the source driver 502 is electrically connected to the data line $SL_1$ to $SL_N$, and the gate driver 503 is electrically connected to the scan line $GL_1$ and $GL_2$. Herein the source driver 502 is used to generate source voltages $VS_1$ to $VS_N$ required for driving the pixel row units 510 and 520. The gate driver 503 is used to generate gate signals $SG_1$ and $SG_2$ required for switching the pixel row units 510 and 520.

Figure 6:
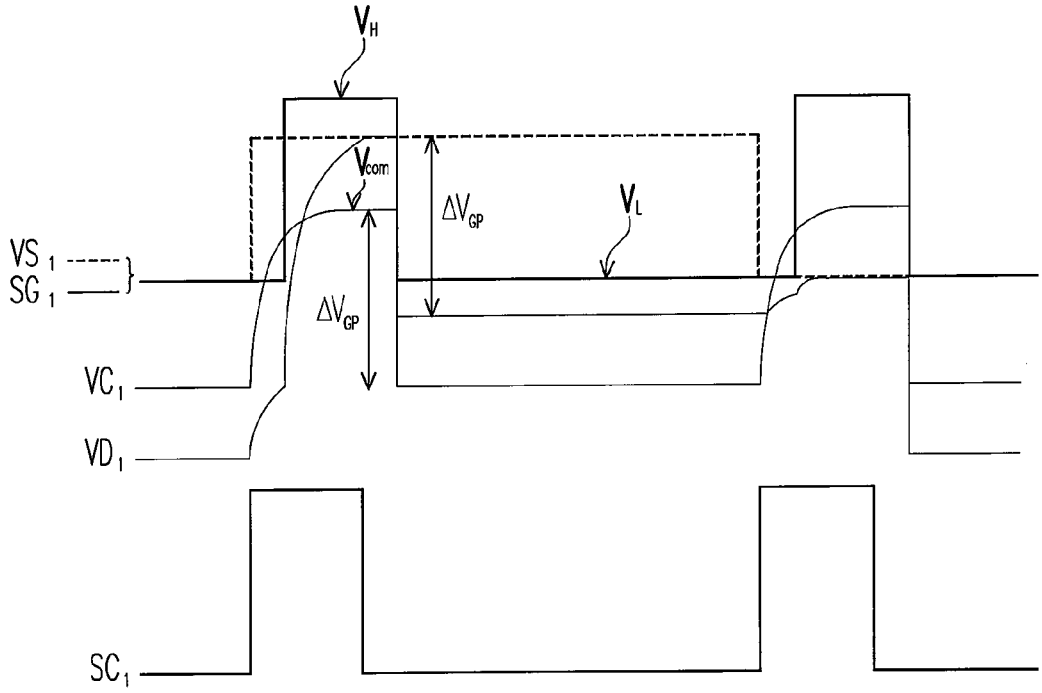
FIG. 6 is a waveform diagram for illustrating the display panel of FIG. 5.
Figure 7A:
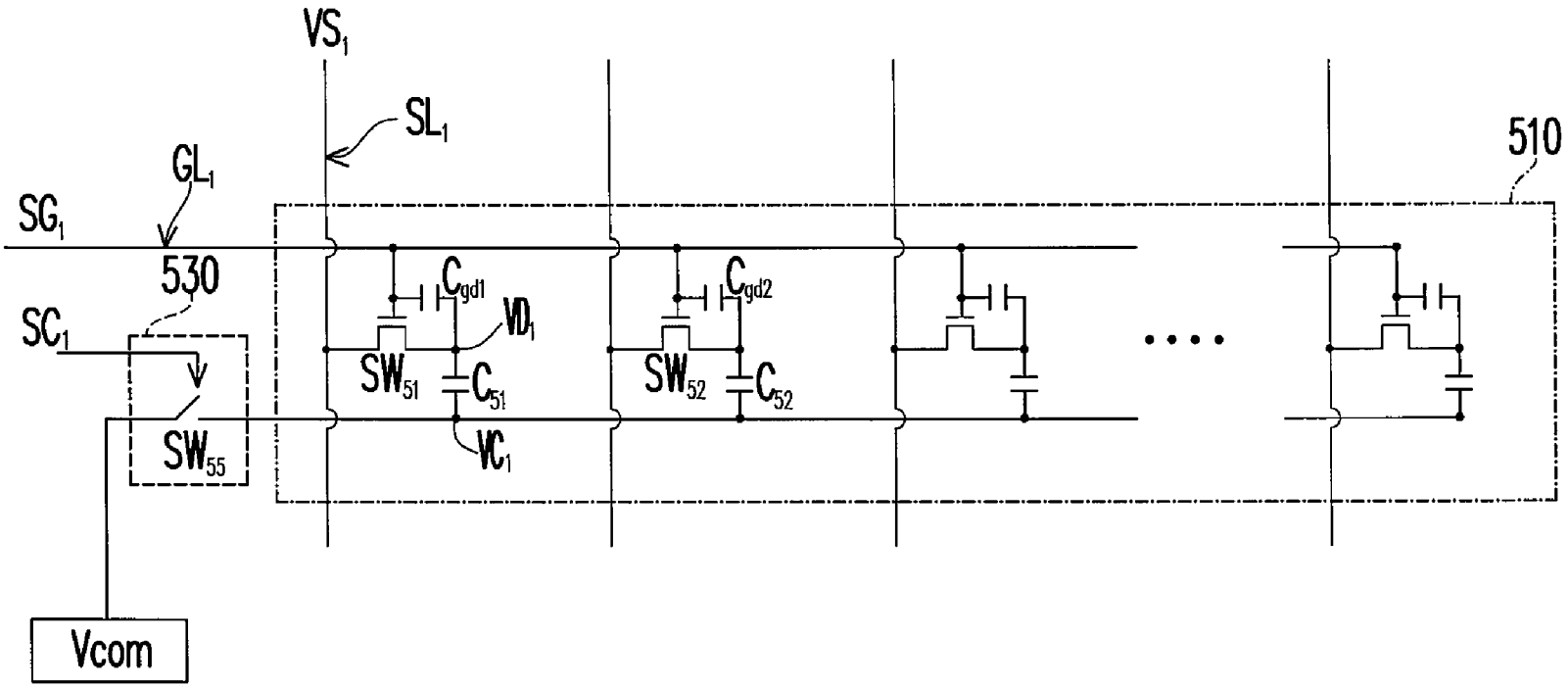
FIG. 7A is a schematic view illustrating a structure of a portion of the display panel of FIG. 5.

FIG. 6 is a waveform diagram for illustrating the display panel of FIG. 5. For illustration purpose, referring to FIG. 7A, the pixel row unit 510 and the switch unit 530 are taken as examples, and node voltages $VD_1$ and $VC_1$ are shown in FIG. 7A. Referring to FIG. 6 and FIG. 7A, the pixel unit $PI_1$ may receive the gate signal $SG_1$ via the scan line $GL_1$, and receive the source voltage $VS_1$ via the data line $SL_1$. The switch unit 530 may determine the conductive state between its first end and its second end according to a potential switch signal $SC_1$, and the potential switch signal $SC_1$ may be provided by the gate driver 503, or may be provided by other members according to the design. It is noted that the switch unit 530 includes at least a switch $SW_{55}$.

Before the gate signal $SG_1$ is switched from a low potential $V_L$ to a high potential $V_H$, that is before the high potential $V_H$ transition of the gate signal $SG_1$, the switch unit 530 will conduct its first end and second end according to the potential switch signal $SC_1$ (for example, a logic 1). Thus, when the gate signal $SG_1$ is a high potential $V_H$, the second end of the storage circuit (liquid crystal capacitance $C_{51}$) is electrically connected to the common voltage $V_{com}$, and the potential of the node voltage $VC_1$ will be also changed to the potential of the common voltage $V_{com}$ according to this. At the same time, because the switch $SW_{51}$ is turned on, the source voltage $VS_1$ will charge the storage circuit (liquid crystal capacitance $C_{51}$), such that the potential of the node voltage $VD_1$ will be changed to the potential of the source voltage $VS_1$.

Figure 7B:
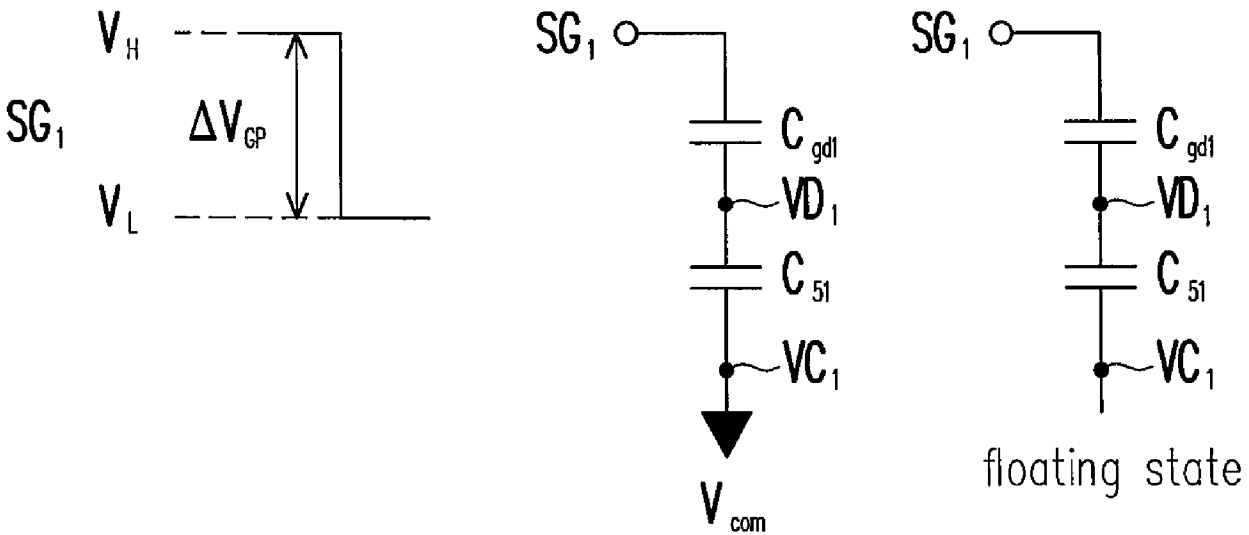
FIG. 7B is a diagram illustrating the operating principle of the pixel unit $PI_1$.

Before the gate signal $SG_1$ is switched from a high potential $V_H$ to a low potential $V_L$, that is before the low potential $V_L$ transition of the gate signal $SG_1$, the switch unit 530 will disconnect its first end and its second end according to the potential switch signal $SC_1$ (for example, a logic 0). At the same time, referring to the operating principle of the pixel unit $PI_1$ as shown in FIG. 7B, if the second end of the storage circuit (liquid crystal capacitance $C_{51}$) is always electrically connected to the common voltage $V_{com}$ ($VC_1=V_{com}$), and the gate signal $SG_1$ is switched from a high potential $V_H$ to a low potential $V_L$, the potential difference $\Delta V_{GP}$ caused by the gate signal $SG_1$ will be respectively stored in the liquid crystal capacitance $C_{51}$ and the parasitic capacitance $C_{gd1}$ according to the law of dividing voltage. In other words, the potential of the node voltage $VD_1$ will be changed at the same time, and the amount of charges stored in the storage circuit (liquid crystal capacitance $C_{51}$) will also be changed correspondingly, wherein the variation of the node voltage $V_{D1}$ is: $\Delta VD_1=\Delta V_{GP}*C_{gd1}/(C_{gd1}+C_{51})$.

However, in the embodiment of FIG. 7, when the gate signal $SG_1$ is switched from a high potential $V_H$ to a low potential $V_L$, the second end of the storage circuit (liquid crystal capacitance $C_{51}$) is on a floating-state, and each of the potentials of the node voltage $V_{D1}$ and $VC_1$ will be reduced by a potential difference $\Delta V_{GP}$ based on the charge conservation theory (as shown in FIG. 6). Thus, before and after the low potential transition of the gate signal $SG_1$, the amount of charges stored in the storage circuit (liquid crystal capacitance $C_{51}$) will remain unchanged. In other words, the pixel units 510 will not change the gray level of the display panel 501.

The other pixel units $PI_2$ to $PI_N$ of the pixel row units 510 will receive the common voltage $V_{com}$ before the high potential $V_H$ transition of the gate signal $SG_1$ in conjunction with the controlling of the switch units 530, and will be switched to a floating-state before the low potential $V_L$ transition of the gate signal $SG_1$. Thereby, they will operate similar to the pixel unit $PI_1$, and the flicker noise of the display panel 501 may be eliminated.

Referring to FIG. 5, the operation mechanism of the pixel row units 520 and the switch unit 540 is identical to that of the pixel row units 510 and the switch unit 530. The switch unit 540 may also determine the conductive state between its first end and its second end according to a potential switch signal $SC_2$, and the potential switch signal $SC_2$ may be provided by the gate driver 503, or may be provided by other members according the design. It is noted that the switch unit 540 includes at least a switch $SW_{56}$.

The switch unit 540 will be controlled by the potential switch signal $SC_2$, such that the pixel units $PII_2$ to $PII_N$ will receive the common voltage $V_{com}$ before the high potential transition of the gate signal $SG_2$, and will be switched to a floating-state before the low potential transition of the gate signal $SG_2$. Thus, before and after the low potential transition of the gate signal $SG_2$, the feed-through effect caused by the parasitic capacitance (for example, $C_{gd3}$, $C_{gd4}$) will not change the amount of charges stored in the storage circuit (for example, liquid crystal capacitance $C_{53}$, $C_{54}$). The rest may be deduced by analogy, it is understood that any of the pixel row units in the display panel 501 may eliminate the flicker noise caused by the feed-through effect under the control of the corresponding switch unit.

Figure 8:
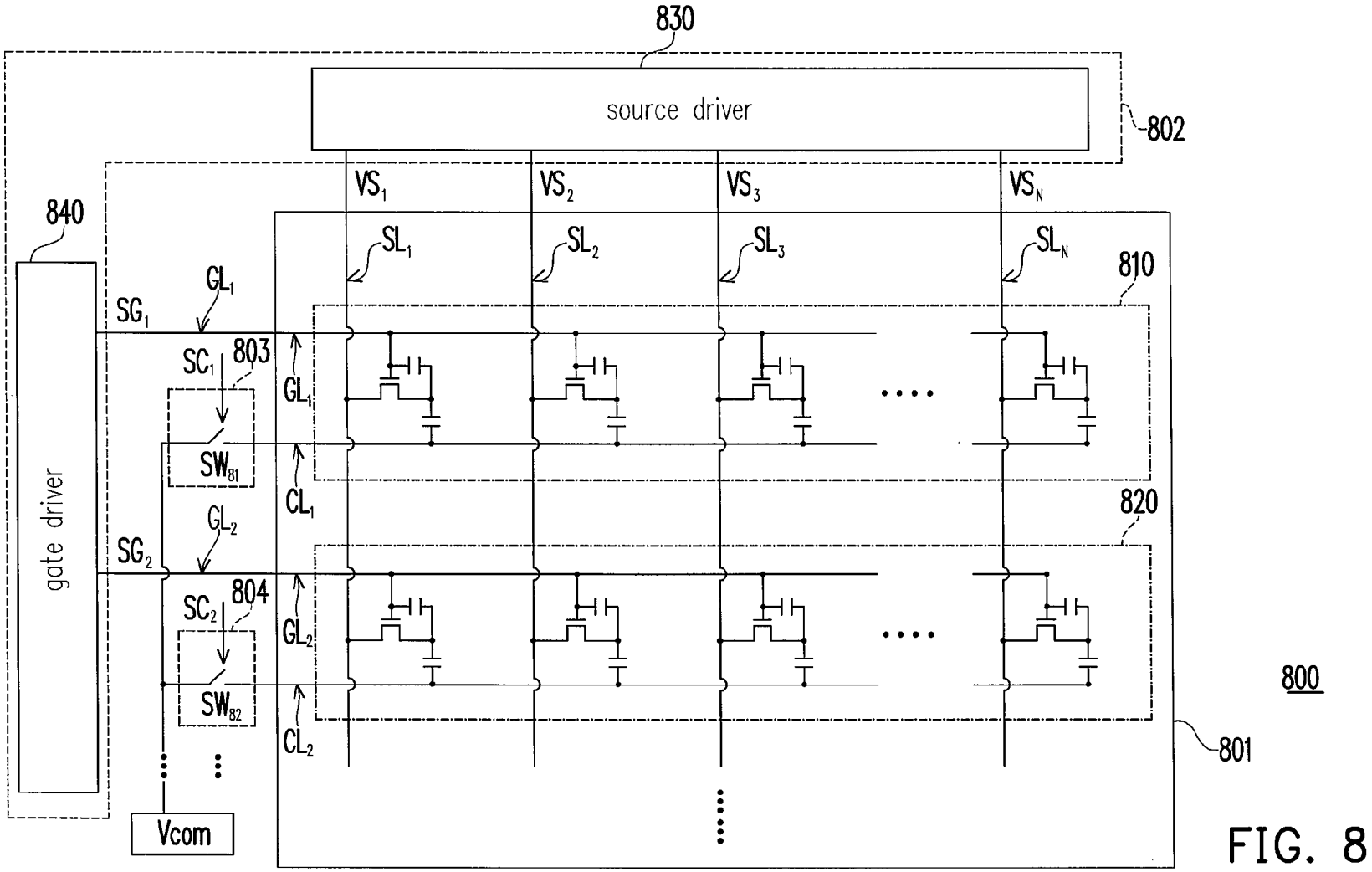
FIG. 8 is a schematic view illustrating a structure of the liquid crystal display according to another embodiment of the present invention.

FIG. 8 is a schematic view illustrating a structure of the liquid crystal display according to another embodiment of the present invention. Referring to FIG. 8, a liquid crystal display 800 comprises a display panel 801, a driving unit 802, and a plurality of switch units, wherein the display panel 801 comprises a plurality of pixel row units. In order to clearly illustrate each member, only switch units 803 and 804 and pixel row units 810 and 820 are illustrated. The embodiment in FIG. 8 is extended from the embodiment in FIG. 5, thus the structure of each pixel row unit in the display panel 801 is the same with the structure of each pixel row unit of the embodiment in FIG. 5.

However, the main difference between the display panel 801 and the display panel 501 is that the display panel 801 is not configured with a switch unit. In order to obtain the function of the display panel 501, the embodiment in FIG. 8 will have the functions of a plurality of switch units in the display panel 501 (for example, switch units 530 and 540) by using a plurality of switch units (for example, the switch units 803 and 804) configured out of the display panel 801.

Thus, the structure of the embodiment in FIG. 8 is the same as that of the embodiment in FIG. 5. The pixel row units 810 are connected between a scan line $GL_1$ and a potential switch line$CL_1$, and the pixel row units 820 is connected between a scan line $GL_2$ and a potential switch line$CL_2$. The first end of the switch unit 803 is used to receive the common voltage Vcom, and the second end of the switch unit 803 is electrically connected to the potential switch line $CL_1$. And the first end of the switch unit 804 is used to receive the common voltage Vcom, and the second end of the switch unit 804 is electrically connected to the potential switch line $CL_2$. Furthermore, the driving unit 802 is electrically connected to the display panel 801.

Furthermore, the driving unit 802 comprises a source driver 830 and a gate driver 840. The source driver 830 is electrically connected to the data lines $SL_1$ to $SL_N$, and the gate driver 840 is electrically connected to the scan lines $GL_1$ and $GL_2$. It is noted that each switch unit in the liquid crystal display 800 comprises at least a switch. For example, the switch unit 803 comprises the switch $SW_{81}$, and the switch unit 804 comprises the switch $SW_{82}$.

Referring to FIG. 8 again, the source driver 830 is used to generate the source voltages $VS_1$ to $VS_N$ required for driving the pixel row units 810 and 820. The gate driver 840 is used to generate the gate signals $SG_1$ and $SG_2$ required for switching the pixel row units 810 and 820. Furthermore, the switch units 803 and 804 will determine the conductive state between their first ends and second ends respectively according to the potential switch signals $SC_1$ and $SC_2$. Wherein, the potential switch signals $SC_1$ and $SC_2$ may be provided by the gate driver 840, or may be provided by other members required for design.

Before the gate signal $SG_1$ is switched from a low potential to a high potential, that is before the high potential transition of the gate signal $SG_1$, the switch unit 803 will conduct its first end and second end according to the potential switch signal $SC_1$. And the pixel row unit 810 regards the common voltage $V_{com}$ as a reference point to receive the source voltage $VS_1$ to $VS_N$ from the source driver 830.

However, before the gate signal $SG_1$ is switched from a high potential to a low potential, that is, before the low potential transition of the gate signal $SG_1$, the switch unit 803 will disconnect its first end and second end according to the potential switch signal $SC_1$. And the pixel row unit 810 are switched to a floating-state, thus the flicker noise caused by the feed-through effect will be suppressed. The mutual operation mechanism of the pixel row unit 820 and the switch unit 804 may be deduced by analogy. Other details may be referred to description of the above embodiment.

In summary, according to an embodiment of the present invention, a switch unit is used to control the time points at that the pixel row units receive the common voltage of the display panel. Thus, before and after the low potential transition of a gate signal, the gray level of the display panel may not be affected by a feed-through effect. In other words, not only the flicker-noise of a display panel is reduced, but also the display-quality of a liquid crystal display is promoted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, suitable for a liquid crystal display, the display panel comprising:

a plurality of pixel row units, each pixel row unit being connected between a scan line and a potential switch line, and receiving a gate signal by its corresponding scan line;

a plurality of switch units, each having a first end and a second end, wherein the first end of each switch unit receives a common voltage of the display panel, and the second end of each switch unit is electrically connected to its corresponding potential switch line, and each switch unit conducts its first end and its second end to transmit the common voltage to its corresponding potential switch line before the high potential transition of its corresponding gate signal, and each switch unit disconnects its first end and its second end to stop transmitting the common voltage before the low potential transition of its corresponding gate signal.

2. The display panel according to claim 1, wherein each pixel row unit includes N pixel units respectively corresponding to N data lines, and wherein N represents an integer that is greater than zero, wherein each pixel unit comprises:

a first switch, having a first end, a second end and a controlling end, the first end being electrically connected to its corresponding data line, the controlling end being electrically connected to its corresponding scan line; and a storage circuit, connected between the second end of the first switch and its corresponding potential switch line, for determining a gray level of the display panel.

3. The display panel according to claim 2, wherein the storage circuit comprises at least a liquid crystal capacitance.

4. The display panel according to claim 2, wherein the first switch is a transistor.

5. The display panel according to claim 2, wherein each pixel unit further comprises a parasitic capacitance electrically connected to its corresponding scan line and the second end of the first switch.

6. The display panel according to claim 2, wherein the data lines are electrically connected to a source driver of the liquid crystal display.

7. The display panel according to claim 1, wherein the scan lines are electrically connected to a gate driver of the liquid crystal display.

8. The display panel according to claim 7, wherein the gate driver of the liquid crystal display generates gate signals and a plurality of potential switch signals, each switch unit may determine the conductive state between its first end and its second end according to its corresponding potential switch signal.

9. The display panel according to claim 1, wherein each switch unit comprises at least a switch.

10. A liquid crystal display, comprising:

a display panel, comprising:

a plurality of pixel row units, each pixel row unit being connected between a scan line and a potential switch line, and receiving a gate signal by its corresponding scan line; and a plurality of switch units, each having a first end and a second end, wherein the first end of each switch unit is used to receive a common voltage of the display panel, and the second end of each switch unit is electrically connected to its corresponding potential switch line, and each switch unit conducts its first end and its second end to transmit the common voltage to its corresponding potential switch line before the high potential transition of its corresponding gate signal, and each switch unit disconnects its first end and its second end to stop transmitting the common voltage before the low potential transition of its corresponding gate signal; and a driving unit electrically connected to the display panel, for driving the display panel.

11. The liquid crystal display according to claim 10, wherein the driving unit comprises:

a gate driver electrically connected to the scan lines for generating the gate signals; and a source driver for generating a plurality of source voltages for driving the pixel row units.

12. The liquid crystal display according to claim 11, wherein the gate driver generates a plurality of potential switch signals, each switch unit determines the conductive state between its first end and its second end according to its corresponding potential switch signal.

13. The liquid crystal display according to claim 10, wherein each pixel row unit includes N pixel units, and N pixel units respectively correspond to N data lines, N represents an integer that is greater than zero, wherein each pixel unit comprises:

a first switch, having a first end, a second end and a controlling end, the first end being electrically connected to its corresponding data line, the controlling end being electrically connected to its corresponding gate line; and a storage circuit, connected between the second end of the first switch and its corresponding potential switch line, for determining a gray level of the display panel.

14. The liquid crystal display according to claim 13, wherein the storage circuit comprises at least a crystal capacitance.

15. The liquid crystal display according to claim 13, wherein the first switch is a thin film transistor.

16. The liquid crystal display according to claim 13, wherein each pixel unit further comprise:

a parasitic capacitance electrically connected to its corresponding scan line and the second end of the first switch.

17. The liquid crystal display according to claim 13, wherein each switch unit comprises at least a switch.

* * * * *